US007703358B2

(12) United States Patent
Ubiñana Felix

(10) Patent No.: US 7,703,358 B2
(45) Date of Patent: Apr. 27, 2010

(54) ADJUSTABLE CLAMP FOR SECURING SHUTTERING PANELS

(75) Inventor: José Luis Ubiñana Felix, Parets Del Valles (ES)

(73) Assignee: Sistemas Technicos De Encofrados, S.A., Parets Del Valles (Barcelona) (ES)

( * ) Notice: Subject to any disclaimer, the term of this patent is extended or adjusted under 35 U.S.C. 154(b) by 223 days.

(21) Appl. No.: 11/911,285

(22) PCT Filed: Apr. 10, 2006

(86) PCT No.: PCT/ES2006/000172

§ 371 (c)(1),
(2), (4) Date: Oct. 11, 2007

(87) PCT Pub. No.: WO2006/108894

PCT Pub. Date: Oct. 19, 2006

(65) Prior Publication Data

US 2008/0193204 A1 Aug. 14, 2008

(30) Foreign Application Priority Data

Apr. 11, 2005 (ES) ..... 200500833

(51) Int. Cl.
*B43L 5/00* (2006.01)
*B25H 3/00* (2006.01)
*A41F 1/00* (2006.01)

(52) U.S. Cl. ..... 81/487; 269/90; 269/218; 24/514

(58) Field of Classification Search ..... 403/190, 403/321, 373, 374.3; 81/487; 269/85, 90, 269/218, 236; 294/106; 24/514; 70/17
See application file for complete search history.

(56) References Cited

U.S. PATENT DOCUMENTS

| | | | | | |
|---|---|---|---|---|---|
| 2,183,680 | A | * | 12/1939 | Kahliff | 269/90 |
| 2,422,865 | A | * | 6/1947 | Tucker | 294/85 |
| 2,432,139 | A | * | 12/1947 | Crowley | 269/218 |
| 2,543,017 | A | * | 2/1951 | Hagan | 24/514 |
| 2,915,096 | A | * | 12/1959 | Mooney | 269/218 |
| 3,039,161 | A | * | 6/1962 | Gagnon | 403/190 |
| 3,984,798 | A | * | 10/1976 | Bussen | |
| 4,541,155 | A | * | 9/1985 | Gagnon | 24/514 |
| 5,146,816 | A | | 9/1992 | Badstieber et al. | |
| 5,598,775 | A | * | 2/1997 | Vongfuangfoo et al. | |

FOREIGN PATENT DOCUMENTS

| | | | |
|---|---|---|---|
| EP | 201887 | A2 * | 11/1986 |
| EP | 565476 | | 10/1993 |

* cited by examiner

*Primary Examiner*—Victor MacArthur
(74) *Attorney, Agent, or Firm*—Darby & Darby P.C.

(57) ABSTRACT

A clamp including two mutually opposed substantially L-shaped members pivotably connected to an intermediate holder supporting the side profile sections of the panel frames to be secured, wherein the two L-shaped members are pivotably interconnected via a central shaft extending through the intermediate holder and said L-shaped members are further pivotably connected to said intermediate holder via two further transverse shafts extending through respective mounting apertures in the intermediate holder.

5 Claims, 8 Drawing Sheets

ADJUSTABLE CLAMP FOR SECURING SHUTTERING PANELS

CROSS-REFERENCE TO RELATED APPLICATIONS

This application is a 371 National Phase of International Application No. PCT/ES2006/000172, filed Apr. 10, 2006, which claims priority under 35 U.S.C. §119 to Spanish Application No. 200500833 filed Apr. 11, 2005, both of which are hereby incorporated by reference in their entireties.

TECHNICAL FIELD

The present invention is intended to disclose a clamp of adjustable type for securing the frames of panels for shuttering concrete, for walls and the like.

BACKGROUND

The use of clamps for securing the frames of the panels for shuttering concrete is well known and numerous types having different characteristics have been used in the course of time.

A clamp for securing concrete panels must basically comply with characteristics of mechanical strength, partly because of the efforts which it must perform during its functioning and partly because of the rough treatment to which concrete shuttering members are customarily subjected during building work.

In addition, clamps of this type must have characteristics of easy and rapid application to the frames of the shuttering panels, in order to facilitate handling.

SUMMARY

The present invention is intended to disclose an adjustable clamp which makes it possible to obtain, with a minimum number of parts and with simplified manufacturing methods for same, a clamp adjustable within wide limits so that it is possible to use it on different types of panels having widths substantially different from the profile sections of the frames, so that a clamp is obtained which is highly effective and of relatively reduced cost.

In order to achieve its aims, the present invention provides for the clamp to be constituted simply by three basic members, two of which are the actual members of the clamp, and substantially L-shaped, and the third is an intermediate support member on which they are articulated and which is intended to receive the profile sections of the frames of the shuttering panels to be joined. The clamp is complemented simply by a threaded rod with its wing nut and pins for articulating the two L-shaped members on the intermediate support.

The L-shaped members are constituted by a base of sheet steel simply cut and pressed, equipped with an assembly of ribs to increase their strength, avoiding any type of welding or other operations which increase the complexity and cost of the clamp and at the same time raise problems regarding protection against corrosion.

Fundamentally, the adjustable clamp of the present invention is constituted by two L-shaped members which assume the structure of double laminar arms, parallel to each other, two of which have ends of a shape complementary to the lateral cavities which the profile sections of the frames of the shuttering boards have in order to permit easy coupling thereof, while the other arms of the L-shaped members are articulated with one another by means of a transverse pin. The two L-shaped members are further articulated by two other points with respective transverse pins.

All the axes of rotation or transverse pivot pins, five in total, pass through the intermediate support, which will customarily have a tubular structure, by means of respective elongated holes, of which the hole which passes through the central axis of the threaded actuating rod is parallel to the axis of said threaded rod, that is, perpendicular to the longitudinal axis of the intermediate support. Of the other elongated holes, two have their axes parallel to the central elongated hole which has been described and the other two are elongated holes in the shape of an arc of a circle, so that the centre and the radius of this arc is such that the path of the central point of the protuberances for contact with the profile sections approximates to a straight line parallel to the intermediate member, so that it is possible to obtain one of the essential characteristics of the clamp of the present invention, which is that the displacement of the L-shaped members for the adjustment of the clamp to different widths of the profile sections to be clamped occurs without changing the relative height of the bearing points with the aforesaid profile sections, thereby obtaining the characteristic of adjustability of the clamp to different widths of profiles, all of which have the same shape of the lateral securing cavities.

BRIEF DESCRIPTION OF THE DRAWING FIGURES

For greater understanding thereof, some drawings which show a preferred embodiment of the present invention are appended by way of non-limiting example.

DETAILED DESCRIPTION OF THE PREFERRED EMBODIMENT

Figure 1:
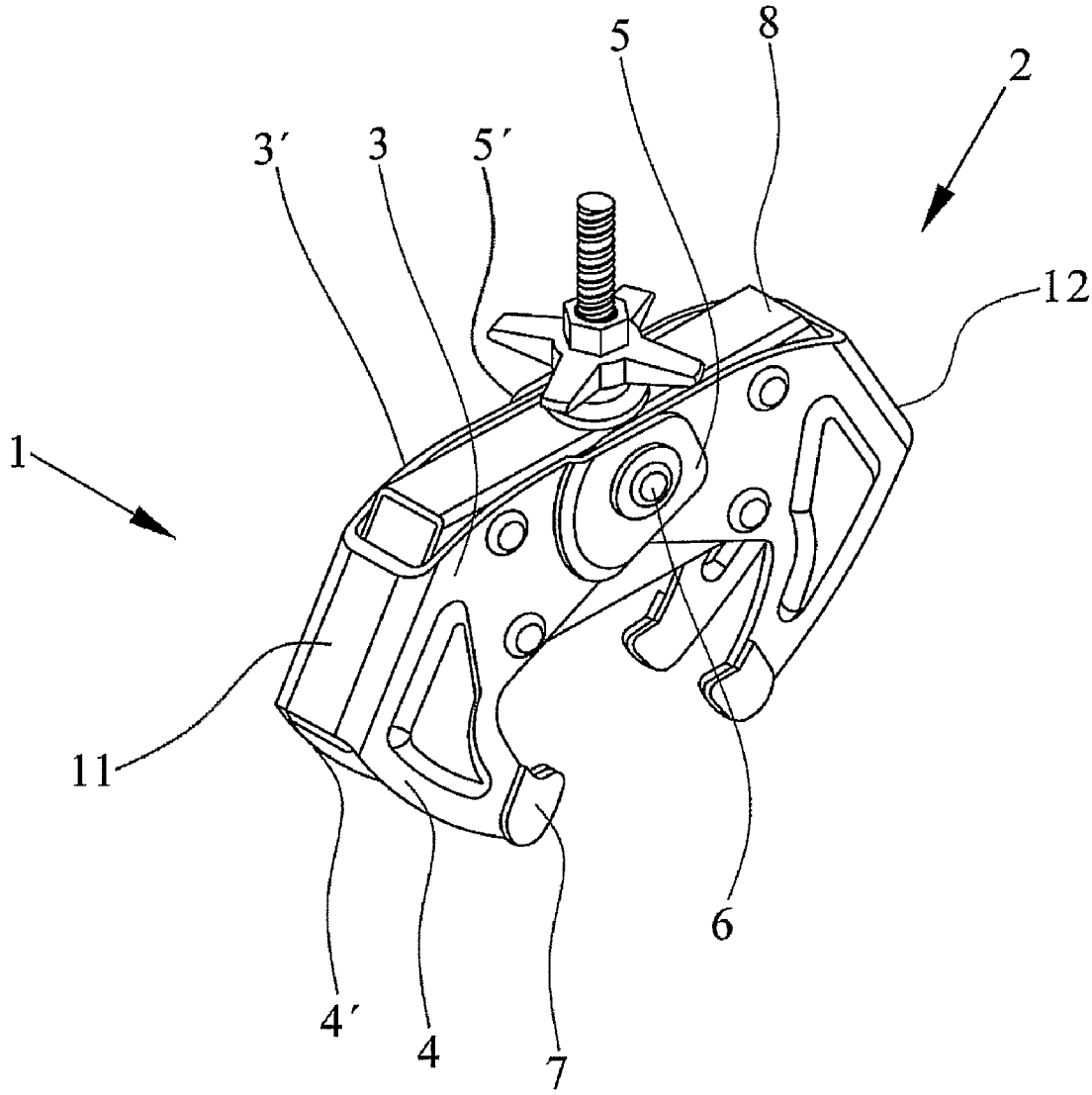
FIG. 1 shows a perspective view of a clamp according to the present invention.
Figure 2:
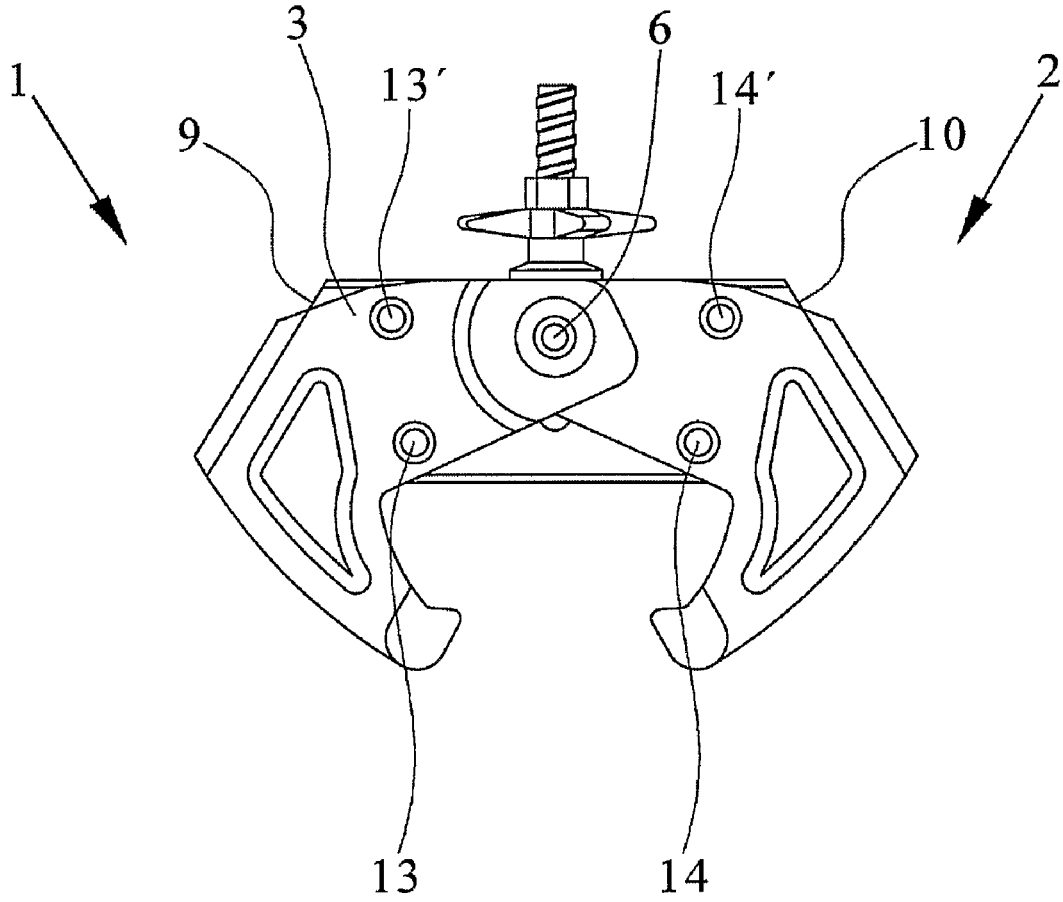
FIG. 2 shows a view in front elevation of the same clamp.
Figure 3:
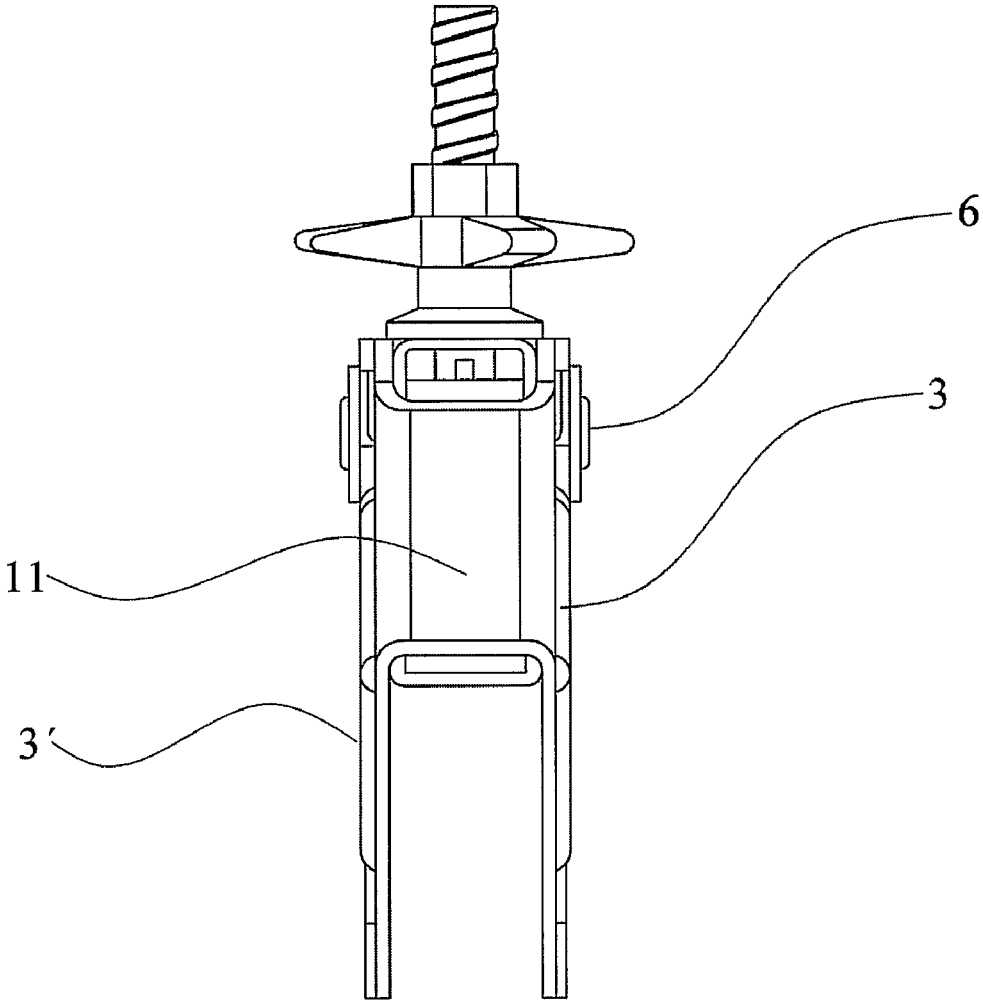
FIGS. 3, 4 and 5 are respectively views in side elevation, in plan and from below of the same clamp.
Figure 4:
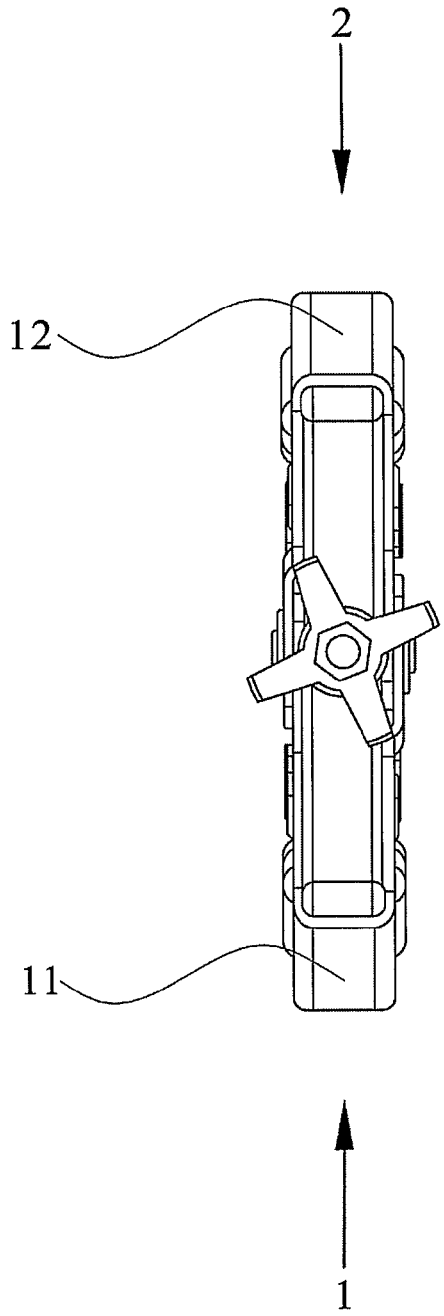
Figure 5:
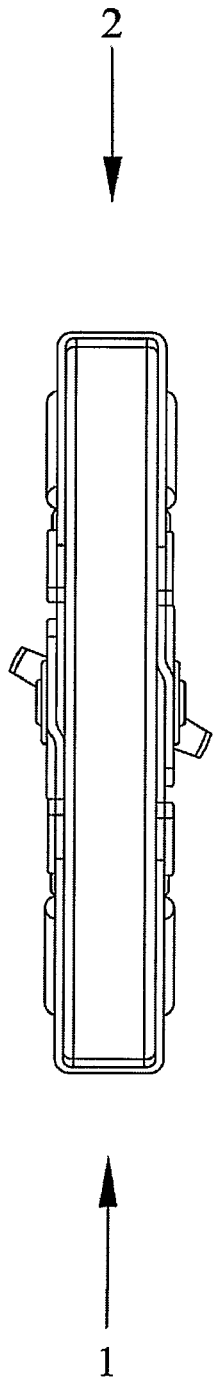

As shown in the drawings, the clamp is constituted fundamentally by two L-shaped members 1 and 2 which have the structure of double arms parallel to one another, such as those shown by the numbers 3, 3', and 4, 4' for the member 1. The end of the arm 3 has an end stamping 5 which overlaps with the corresponding non-stamped arm of the member 2 and is traversed by the central pivot pin 6. On the other side, the stamping 5' is provided on the arm of the member 2, and it is the arm 3' of the member 1 which is flat, without stamping. The ends of the arms 4 and 4' have profiles 7 of a shape complementary to the profile sections of the frames of the shuttering panels which they are to clamp, preferably reinforced by means of auxiliary plates that are welded or joined in some other way, as may be observed in FIG. 1.

Figure 6:
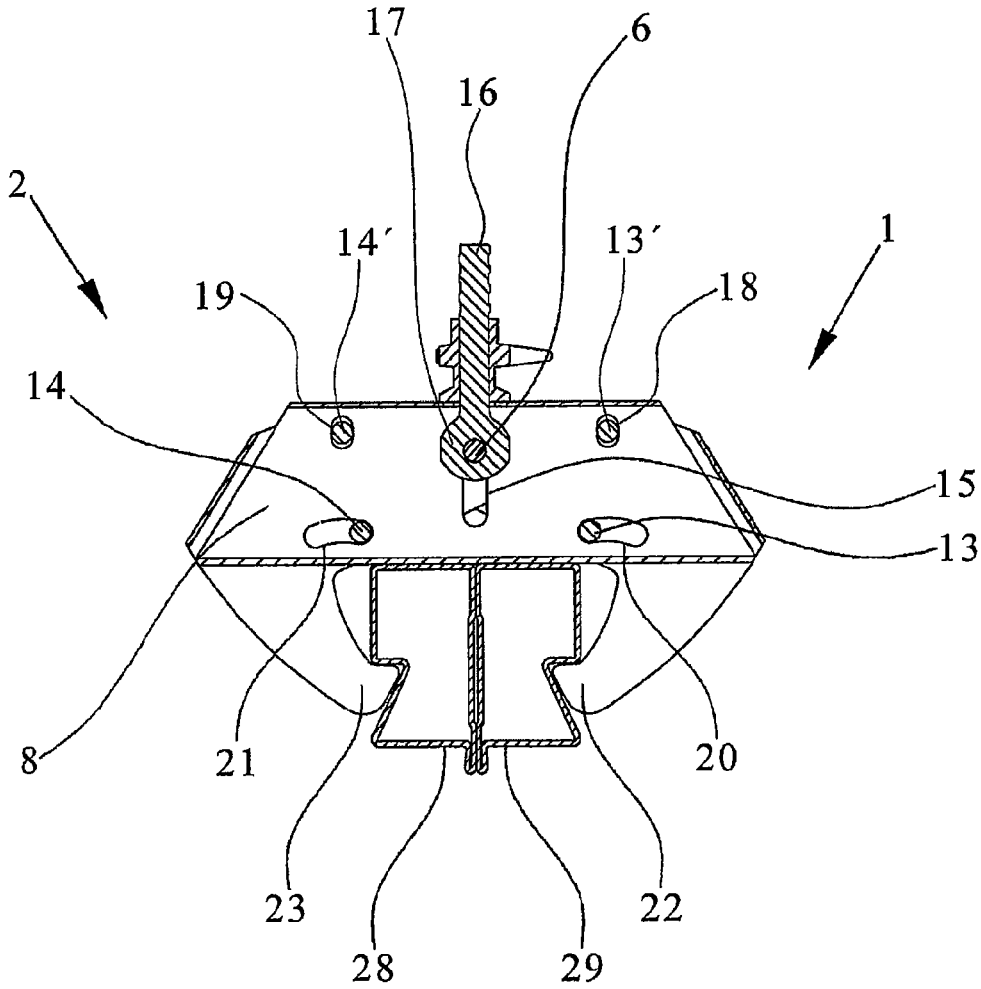
FIG. 6 shows a longitudinal section through the clamp in the position for minimum width of the securing jaw.

The two L-shaped members 1 and 2 are articulated on an intermediate support 8 which is intended to receive the profile sections which form part of the frames of the shuttering panels to be joined, as shown by way of example in FIG. 6.

Said intermediate support 8 is preferably tubular and has its ends 9 and 10 cut in a bevel and surrounded by the end bridges 11 and 12 for joining the double arms of the L-shaped members 1 and 2.

Figure 7:
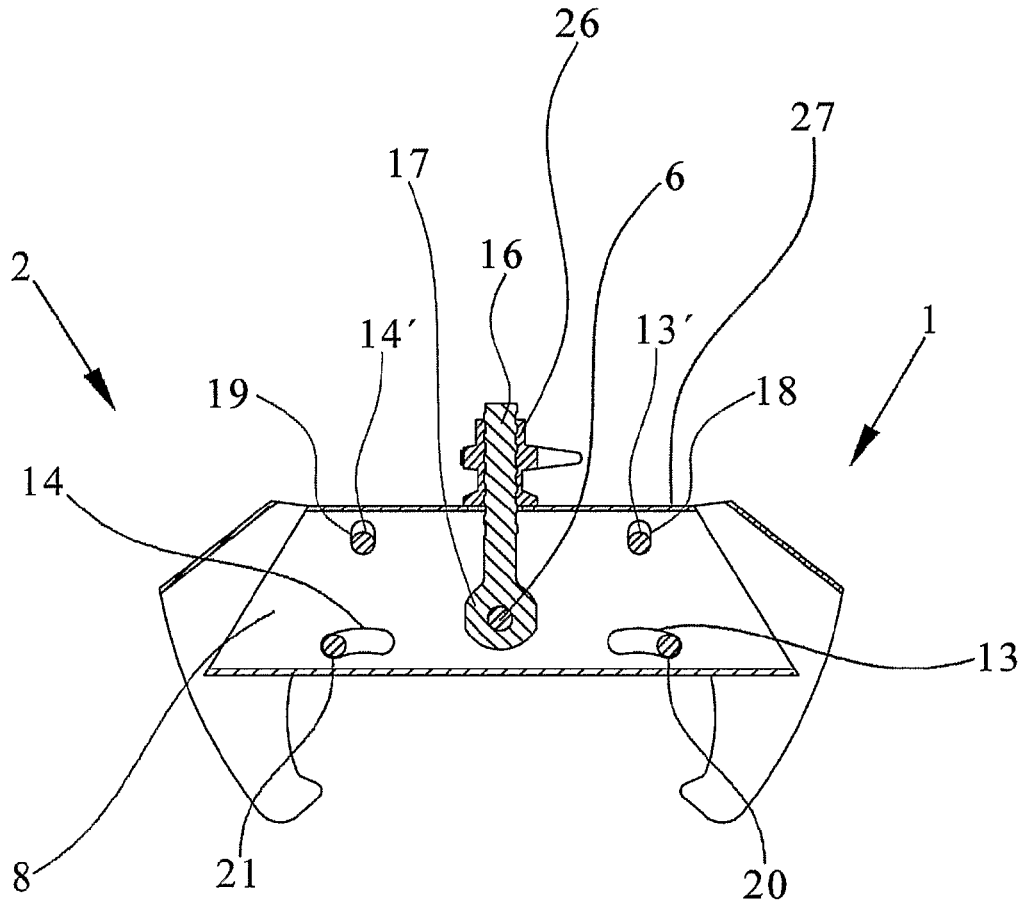
FIG. 7 shows a view analogous to FIG. 6 in the position for maximum width of adjustment.
Figure 8:
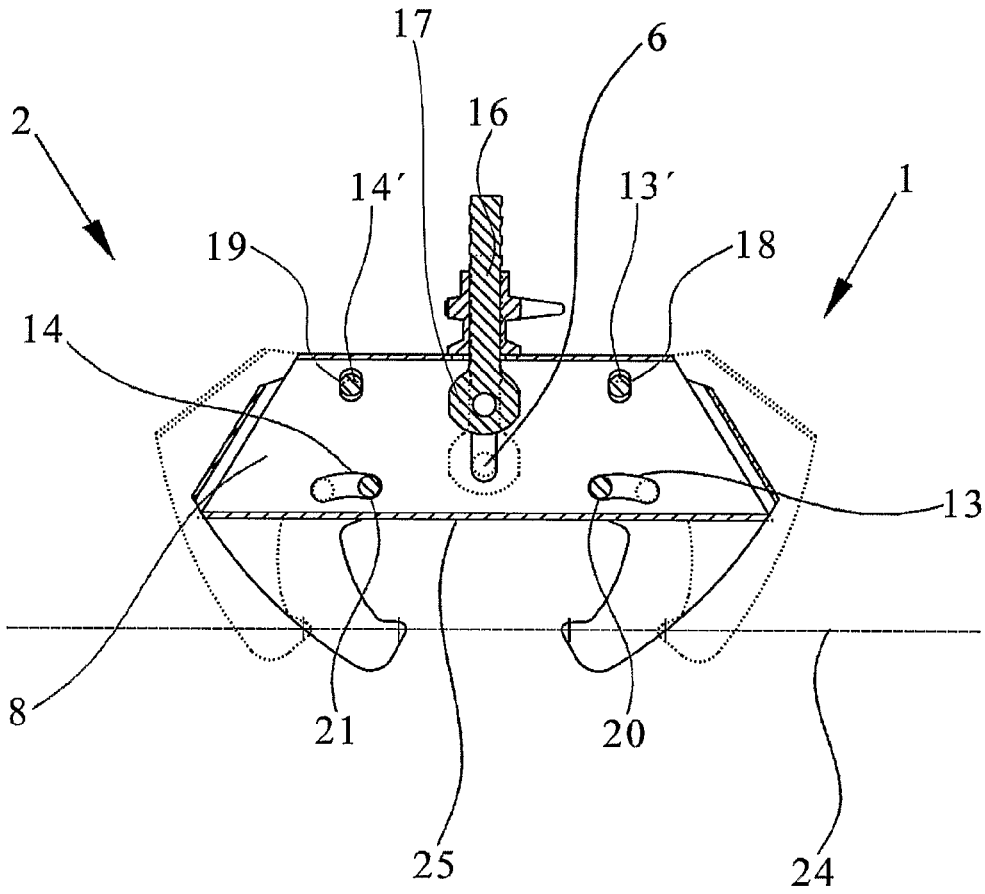
FIG. 8 shows a sectional view which shows diagrammatically the positions for minimum and maximum opening of the jaw of the clamp in order to show the displacement of the points of attack of the clamp parallel to the bearing face of the intermediate support.

The articulation of the L-shaped members is effected by means of the central pin 6 and four other pins, two for each L-shaped member, which have been indicated by the numbers 13 and 13' for the member 1, and 14, 14' for the L-shaped member 2. All the pivot pins pass through the intermediate support 8 by means of corresponding elongated holes, as can be seen in FIGS. 6 to 8. The central pin 6 passes through the inside of a straight elongated hole 15 parallel to the axis of the threaded actuating rod 16 and, therefore, perpendicular to the axis of the intermediate support 8. Said pin 6 also passes through an end head 17 of the threaded rod 16, which carries coupled on it a wing nut 26 which permits the adjustment of the clamp, bearing on the side 27 of the intermediate support 8. The pins 13' and 14' move within respective straight elongated holes 18 and 19 which are parallel to the elongated hole 15, and finally the pins 13 and 14 move within respective curved elongated holes 20 and 21 which are in the shape of an arc of a circle, so that the centre and the radius of this arc is such that the trajectory of the central point of the protuberances 22 and 23 for contact with the profile sections approximates to a straight line 24 parallel to the intermediate member.

By means of this arrangement, it is possible for the adjustment of the clamp to be effected, as can be seen in FIG. 8, in such a way that the bearing points of the arms of the clamp that are intended to clamp the profile sections of the frames of the shuttering panels are displaced on a line 24 which is parallel to the upper face 25 of the intermediate support 8. In this way the correct securing of the profile sections of the frames of shuttering panels is facilitated for any values within a wide range of widths which may vary, for example, by 100 mm or more.

FIG. 6 shows diagrammatically two profile sections 28 and 29 of respective frames of shuttering panels, these not having been shown in the rest of the views for the purpose of simplification.

As will be understood, the embodiment which has been shown is solely exemplary in nature, and experts in the field, after becoming aware of the present description, drawings and claims, may introduce numerous variants to the matter of the present invention which will be included in the scope thereof provided that they correspond to the attached claims.

The invention claimed is:

1. An adjustable clamp for securing shuttering panels, comprising:

a pair of substantially L-shaped members arranged opposite one another;

an intermediate support on which the pair of L-shaped members articulate;

wherein one arm of each L-shaped member has an end profile adapted for coupling the one arm to the profile sections of the frames of the panels to be clamped, while another arm of each L-shaped member receives a displacement device for effecting rotation of the other arm, causing the opening and closing of the L-shaped members of the clamp;

wherein the pair of L-shaped members are articulated by a central pin which passes through the intermediate support, and each of the L-shaped members is further articulated on the intermediate support by means of first and second transverse pins which pass through respective elongated holes in the intermediate support.

2. The adjustable clamp of claim 1, wherein the central pin for articulation of the two L-shaped members with each other passes through an inside of an elongated hole in the intermediate support, perpendicular to the longitudinal axis of the intermediate support.

3. The adjustable clamp of claim 1, wherein the central pin of the two L-shaped members passes through ahead of a threaded rod coupled to the intermediate support, which has incorporated on it a fixing nut which acts on a face one of the faces of the intermediate support.

4. The adjustable clamp of claim 1, wherein the first transverse pin passes through an inside of the respective elongated hole, the respective elongated hole being parallel with an elongated hole receiving the central pin for articulation of both L-shaped members, and wherein the second transverse pin passes through an inside of the respective elongated hole in a shape of an arc of a circle.

5. The adjustable clamp of claim 4, wherein both a center and a radius of the circle of the respective elongated hole in a shape of an arc are such that the circle and the radius permit an adjustment of the clamp so that points of attack of the arms of the clamp on the profile sections are displaced on a straight line parallel to the intermediate member, in order to permit the adjustment of the clamp so that the points of attack of the arms of the clamp on the profile sections remain parallel with respect to a face of the intermediate support on which the profiles section bear.

* * * * *